US008943652B2

(12) United States Patent
Bacchetti

(10) Patent No.: US 8,943,652 B2
(45) **Date of Patent: *Feb. 3, 2015**

(54) HINGE FOR COLD ROOMS, SWING GATES OR THE LIKE

(75) Inventor: Luciano Bacchetti, Nave (IT)

(73) Assignee: IN&TEC S.R.L., Brescia (IT)

( * ) Notice: Subject to any disclaimer, the term of this patent is extended or adjusted under 35 U.S.C. 154(b) by 930 days.

This patent is subject to a terminal disclaimer.

(21) Appl. No.: 13/130,243

(22) PCT Filed: Aug. 4, 2010

(86) PCT No.: PCT/IB2010/053535

§ 371 (c)(1),
(2), (4) Date: May 19, 2011

(87) PCT Pub. No.: WO2011/016000

PCT Pub. Date: Feb. 10, 2011

(65) Prior Publication Data

US 2011/0219583 A1 Sep. 15, 2011

(30) Foreign Application Priority Data

Aug. 6, 2009 (IT) ..... VI2009A0211

(51) Int. Cl.

| | |
|---|---|
| ***E05D 7/08*** | (2006.01) |
| ***E05F 1/00*** | (2006.01) |
| ***E05F 1/12*** | (2006.01) |

(Continued)

(52) U.S. Cl.

CPC ..... *E05F 1/1253* (2013.01); *E05D 11/1014* (2013.01); *E05F 3/104* (2013.01); *E05F 3/20* (2013.01); *E05D 7/081* (2013.01); *E05Y 2201/638* (2013.01); *E05Y 2600/41* (2013.01); *E05Y 2600/452* (2013.01); *E05Y 2900/102* (2013.01); *E05Y 2800/26* (2013.01)

USPC ..... 16/378; 16/71; 16/72; 16/49; 16/53

(58) Field of Classification Search

USPC ..... 16/387, 286, 54, 55, 71, 49, 51, 58, 59, 16/80, 72; 49/339, 334, 340, 323, 324, 49/344, 137, 138

See application file for complete search history.

(56) References Cited

U.S. PATENT DOCUMENTS

| | | | | |
|---|---|---|---|---|
| 4,847,946 | A * | 7/1989 | Nam et al. | 16/53 |
| 5,090,089 | A * | 2/1992 | Schulte et al. | 16/49 |

(Continued)

FOREIGN PATENT DOCUMENTS

| | | |
|---|---|---|
| EP | 0407150 | 1/1991 |
| EP | 1997994 | 12/2008 |

(Continued)

*Primary Examiner* — Chuck Mah
(74) *Attorney, Agent, or Firm* — Themis Law

(57) ABSTRACT

A hinge for cold rooms, swing gates or the like includes a stationary support structure and at least a door movable between an open door position and a closed door position. The hinge comprises a box-like hinge body and a pin rotatably coupled to rotate about a first axis between the open door position and the closed door position. Closing means are provided for automatically returning the door, as well as a working fluid acting thereon to hydraulically contrast their action. The closing means comprise a cam element unitary with the pin interacting with a plunger element housed in an operating chamber defined within the box-like hinge body. The box-like hinge body has an elongated shape to define a second axis perpendicular to the first axis.

21 Claims, 8 Drawing Sheets

(51) Int. Cl.

| | |
|---|---|
| ***E05D 11/10*** | (2006.01) |
| ***E05F 3/10*** | (2006.01) |
| ***E05F 3/20*** | (2006.01) |
| ***E05D 7/081*** | (2006.01) |

(56) References Cited

U.S. PATENT DOCUMENTS

| | | | | |
|---|---|---|---|---|
| 5,901,412 | A * | 5/1999 | Jentsch | 16/72 |
| 6,658,694 | B2 * | 12/2003 | Wang | 16/50 |
| 7,003,847 | B2 * | 2/2006 | Brown | 16/53 |
| 7,007,341 | B2 * | 3/2006 | Wang | 16/60 |
| 7,900,319 | B2 | 3/2011 | Bacchetti | |
| 2002/0066157 | A1 * | 6/2002 | Chen | 16/58 |
| 2004/0206007 | A1 | 10/2004 | Chiang | |
| 2007/0033768 | A1 * | 2/2007 | Ginzel | 16/71 |
| 2007/0228742 | A1 | 10/2007 | Chiang | |
| 2010/0024159 | A1 * | 2/2010 | Oh et al. | 16/54 |

FOREIGN PATENT DOCUMENTS

| | | |
|---|---|---|
| JP | 3104187 U | 6/2004 |
| WO | 2007125524 | 11/2007 |

* cited by examiner

HINGE FOR COLD ROOMS, SWING GATES OR THE LIKE

FIELD OF THE INVENTION

The present invention is generally applicable in the technical field of closing hinges, and particularly relates to a hinge for cold rooms, swing gates or the like.

BACKGROUND OF THE INVENTION

As known, closing hinges generally comprise a movable element, usually fixed to a door or the like, and pivoted on a stationary element, usually fixed to the support frame thereof.

Moreover, closing means acting on the movable element to automatically return the door or the like to the closed position are provided.

In the case of cold rooms, swing gates or the like, which comprise a stationary support structure and at least one door which includes a substantially tubular frame to which a double-glazing unit is fixed, the hinges have both the movable and the stationary elements visible from the outside, external to both the door and the support structure. Such solution is uncomfortable, bulky, unaesthetic and not very effective.

Furthermore, the external position of such known hinges makes them extremely exposed to risks of damages and wear.

From documents U.S. Pat. No. 7,305,797, US2004/206007 and EP1997994 hinges are known, in which the action of the closing means which ensure the return of the door to the closed position is not counteracted. Consequently the risk exists that the door strongly impacts against the support frame, damaging itself.

From the document EP0407150 a door closer is known, which includes hydraulic damping means to counteract the action of the closing means. Such known device is extremely bulky, therefore it must necessarily be mounted on the floor.

The installation of such a device thus requires expensive and difficult break-in works on the floor, which have to be made by qualified operators.

SUMMARY OF THE INVENTION

Object of the present invention is to overcome at least partly the above drawbacks, by providing a hinge having characteristics of high functionality, constructional simplicity and low cost.

Another object of the invention is to provide a hinge for cold rooms, swing gates, or the like, that is not bulky.

Another object of the invention is to provide a hinge for cold rooms, swing gates, or the like, which can be hidden by inserting within the tubular frame thereof.

Another object of the invention is to provide a hinge which ensures the automatic closing of the door from the open position.

Another object of the invention is to provide a hinge which ensures the controlled movement of the door on which it is mounted, upon the opening as well as upon closing of the door.

Another object of the invention is to provide a hinge which is capable of supporting also very heavy doors and windows, without changing its behavior and without need of any adjustment.

Another object of the invention is to provide a hinge which has a minimum number of constituent parts.

Another object of the invention is to provide a hinge capable of maintaining with time the exact closing position.

Another object of the invention is to provide an extremely safe hinge, which does not offer any resistance to closing if pulled.

Another object of the invention is to provide a hinge which is extremely easy to install.

Such objects, as well as others which will appear more clearly hereinafter, are fulfilled by a hinge according to the invention.

The hinge according to the invention comprises a stationary element, suitable to be anchored to a stationary support structure of a swing gate, a cold room or the like, and a movable element, suitable to be anchored to the movable door of the swing gate, cold room or the like.

The movable element is rotatably coupled to the stationary one such to rotate on a longitudinal axis between an open door position and a closed door position.

The hinge comprises closing means acting on the movable element to automatically return the door to the closed position.

Furthermore, the hinge comprises a working fluid, generally oil, acting on the closing means to hydraulically counteract the action thereof, adjusting the rotation of the door from the open to the closed door position. The movable element, respectively the stationary element, may comprise a box-like hinge body defining an operating chamber and which may have an elongated shape along an axis.

Thanks to such combination of features, the hinge may be hidden to the sight by inserting it within the tubular profile defining the frame of the door of a cold room, a swing gate or the like, or within the stationary support structure of the door.

The closing means and the hydraulically counteracting means are entirely housed in one single operating chamber, internal to the movable or to the stationary element.

Thanks to such features, the hinge will be very compact and effective, and with a strong aesthetic impact.

The closing means comprise a cam element, unitary with one between the stationary and the movable element, which interacts with a plunger element, movable within the other of the stationary and the movable elements and movable along an axis substantially perpendicular to the rotation axis between the stationary and movable element.

Thanks to such features, the hinge will have a minimum number of constituent parts, with great advantage of the bulkiness of the hinge.

Furthermore, by shaping the hinge in this manner, it can maintain the exact closing position with time, by being also safe.

Such embodiment provides for a hinge which ensures the controlled movement of the door upon the opening, thus being highly safe and practical.

Due to bulk reasons, the operating chamber defined by the box-like hinge body may include the cam element as well as the plunger element.

In order to minimize vertical bulk, the plunger element may have a generally plate-like shaped pushing head for defining a plane substantially perpendicular to the rotation axis of the stationary and the movable element.

Appropriately, and independently from the shape of the pushing head of the plunger element, the latter may be configured so as to separate the operating chamber into a first and a second adjacent variable volume compartments in reciprocal fluidic communication, which may be designed to have in correspondence with the closed door position respectively the maximum and the minimum volume and vice versa in the open door position the minimum and the maximum volume.

Advantageously, and independently from the shape of the pushing head of the plunger element, the operating chamber may comprise control means to control the flow of the working fluid to allow the flow thereof from the first to the second compartment upon the opening of the door and from the second to the first compartment upon the closing of the door.

Thanks to such features, the hinge according to the invention will allow hydraulically controlling the rotation upon the closing of very heavy doors, by also minimizing the bulking.

Advantageously, and independently from the shape of the pushing head of the plunger element, the control means to control the flow of the working fluid may comprise a hydraulic circuit within the box-like hinge body for the controlled backflow of the working fluid from the second to the first variable volume compartment upon the closing of the door.

Thanks to such features, the hinge according to the invention will be extremely safe, because the reciprocal rotating movement of the stationary and of the movable element is free upon closing. In fact, during the closing phase, the control means will adjust the backflow of the working fluid from the second to the first variable volume compartment independently from the reciprocal rotation of the stationary and of the movable element, so that an user will be free to close the door at any speed without any danger of breaking the hinge and/or the door.

Appropriately, and independently from the shape of the pushing head of the plunger element, the control means to control the flow of the working fluid may furthermore comprise first means for adjusting the flow of the working fluid in the hydraulic circuit, in such a manner as to adjust the rotation speed of the door from the open to the closed position.

On the other side, independently from the shape of the pushing head of the plunger element and from the presence—or the absence—of the first adjusting means, the control means to control the flow of the working fluid may comprise second means for adjusting the flow of the working fluid in the hydraulic circuit, in such a manner as to adjust the torque with which the door reaches the closed position.

Appropriately, such second adjusting means may be designed to impart to the door a latch action towards the closed position when the plunger element is in proximity of the extended end position.

In a preferred but not exclusive embodiment, independently from the shape of the pushing head of the plunger element, the hinge may comprise a first and a second hydraulic circuit.

In such embodiment the first hydraulic circuit may comprise first means for adjusting the flow of the working fluid, in such a manner as to adjust the rotation speed of the door from the open to the closed position, whereas the second hydraulic circuit may comprise second means for adjusting the flow of the working fluid in the hydraulic circuit, in such a manner as to adjust the torque with which the door reaches the closed position, preferably designed to impart to the door a latch action when the plunger element is in the proximity of the extended end position.

Appropriately, a fluidic connection between the two circuits may be provided, so that the hinge has the same characteristics in both opening senses of the door.

Advantageous embodiments of the invention are recited in the dependent claims.

BRIEF DESCRIPTION OF THE DRAWINGS

Further features and advantages of the invention will appear more evident upon reading the detailed description of a few preferred, non-exclusive embodiments of a hinge according to the invention, which are described as non-limiting examples with the help of the annexed drawings, in which.

DETAILED DESCRIPTION OF A PREFERRED EMBODIMENT

Referring to the above mentioned figures, the hinge according to the invention, generally indicated by numeral 1, is advantageously applicable to cold rooms, outer swing gates or similar applications, which comprise a stationary support structure S and a door A, movable between an open door position and a closed door position.

Figure 1:
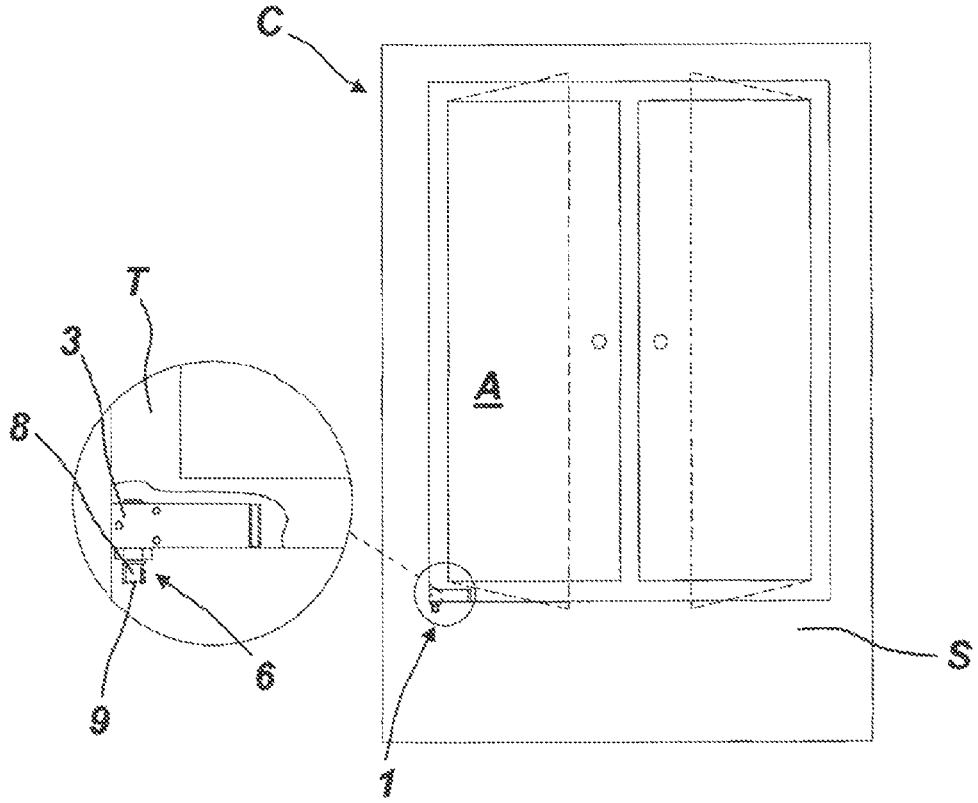
FIG. 1 is a schematic view of an embodiment of the hinge 1 mounted within the tubular frame T of a door A of a cold room.
Figure 2:
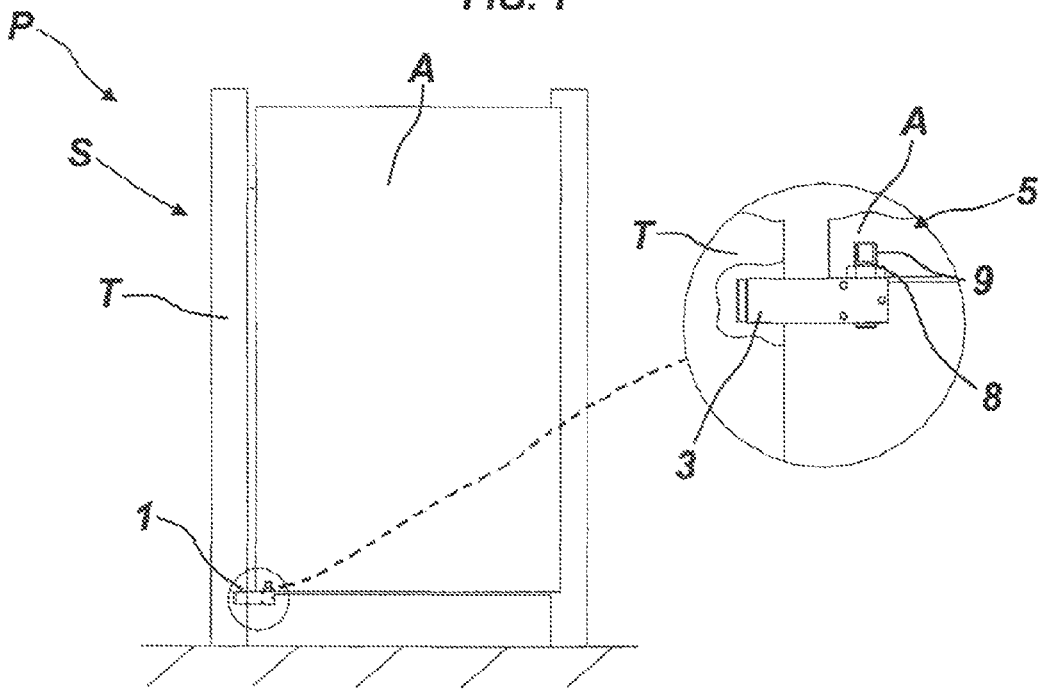
FIG. 2 is a schematic view of an embodiment of the hinge 1 mounted within the tubular frame T of the stationary support structure S of a swing gate P, having a movable door A.
Figure 3:
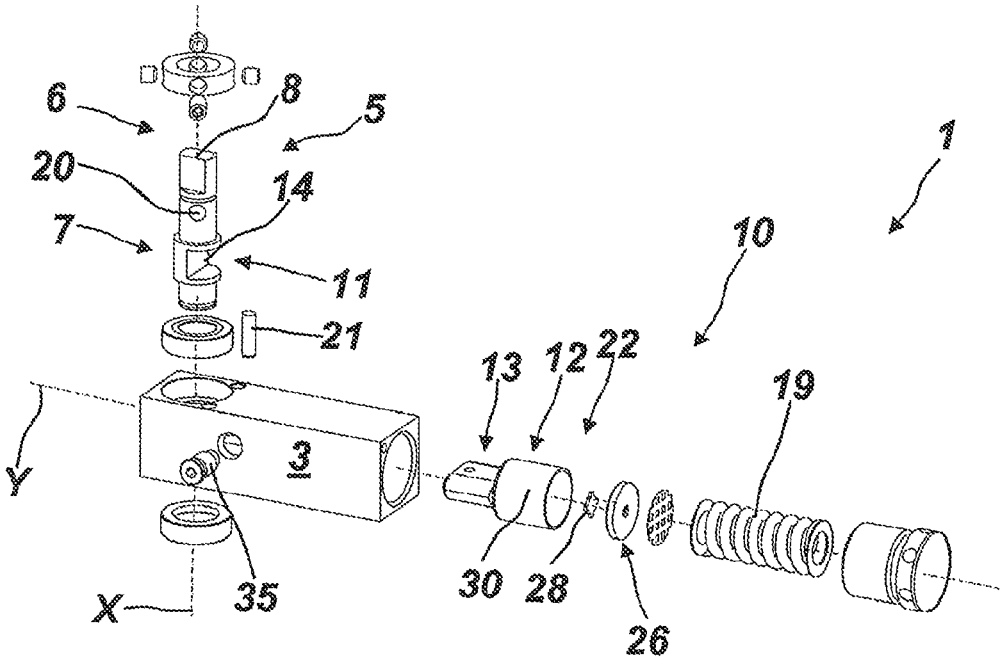
FIG. 3 is an exploded view of a first embodiment of the hinge 1.
Figure 4:
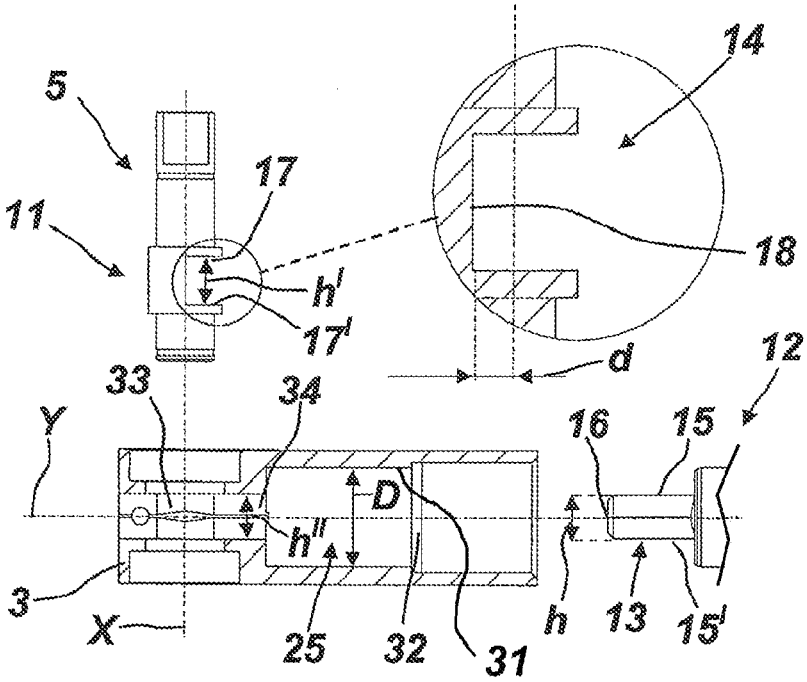
FIG. 4 is a sectional, partially exploded view of a few details of the hinge of FIG. 3.

Preferably, as visible in FIGS. 1 and 2, the hinge 1 may be partially or totally inserted in the tubular frame T of the door A or of the support structure S. In this manner, it will be possible to install the hinge 1 easily and smoothly, avoiding for instance the break-in works which are necessary with the known solutions.

The hinge 1 may be used individually, with a simple hinge on the other end of the door A, or in a combination of two or more of said hinges.

FIG. 1 shows, as a mere non-limiting example of the invention, an embodiment of the hinge 1, which is hidden to the sight by inserting it in the tubular frame T of the door A of cold room C, which has a support structure S.

FIG. 2 shows, as a mere non-limiting example of the invention, a further embodiment of the hinge 1, which is partially hidden to the sight by inserting within the tubular frame T of the stationary support structure S of a swing gate P, having a movable door A.

Although in such embodiments the hinge 1 is horizontally inserted in the frame T, it is understood that such hinge can be also vertically inserted in the frame T.

FIGS. 3 to 5B show a first embodiment of the hinge according to the invention, particularly but non-exclusively suitable for cold rooms, whereas FIGS. 6 to 13C show a second embodiment of the hinge according to the invention, particularly but non-exclusively suitable for swing gates.

Where not differently specified, in the description below technical features common to both embodiments will be indicated. Such common features may be for convenience designated by a single reference numeral.

In particular, the hinge 1 comprises a box-like hinge body 3 rotatably coupled to a pin 5, in such a manner to rotate about a first longitudinal axis X, which may be substantially vertical.

In the embodiment of FIG. 1 the box-like body 3 is anchored to the door A of the cold room C to define the movable element of the hinge 1 , whereas the pin 5 is anchored to the stationary support structure S of the hinge to define the stationary element thereof.

Vice versa, in the embodiment of FIG. 2 the box-like body 3 is anchored to the stationary support structure S of the swing gate P to define the stationary element of the hinge 1, whereas the pin 5 is anchored to the door A of the stationary element to define the movable element.

The pin 5, which may have an elongated shape to define the axis X, may be partially inserted in the box-like hinge body 3, so as to have a first portion 6 outcoming from said box-like hinge body and a second portion 7 internal to the body 3. The first and the second portion may be monolithic, as they are both part of the same pin 5.

The first portion 6 may have a fastener 8 insertable in a countershaped housing 9, realized in the stationary support structure S in the example of FIG. 1 and in the door A in the example of FIG. 2.

In this manner an user, opening the door A of the cold room C or of the swing gate P, will cause the reciprocal rotation of the box-like hinge body 3 and of the pin 5 around the axis X.

In order to ensure the automatic closing of the door A once opened, closing means may be provided, generally indicated with 10, acting on the movable element of the hinge 1 to automatically return the door A to the closed position.

A working fluid, generally oil, acting on the closing means 10 to hydraulically counteract the action thereof, may be furthermore provided.

By suitably controlling the action of the working fluid, it will be possible to control the rotation of the door A from the open to the closed position. This will allow, for example, preventing the door A from strongly impacting the frame.

More generally, the hinge according to the invention ensures a controlled movement of the door upon the opening as well as upon the closing thereof.

In fact, upon opening, the controlled movement will prevent the door from suddenly opening, so as to protect both the door itself and a possible user who is in the corresponding action area. Appropriately, the closing means 10 may comprise a cam element, generally designed by numeral 11, unitary with the pin 5, and more precisely made in correspondence with the inner portion 7 of the pin 5.

As used herein, the term "cam" means a mechanical part, having any configuration, suitable to change a circular motion into a rectilinear motion.

The cam element 11 will interact with a plunger element, designated by the numeral 12, slidably movable within the box-like hinge body 3.

Figure 5A:
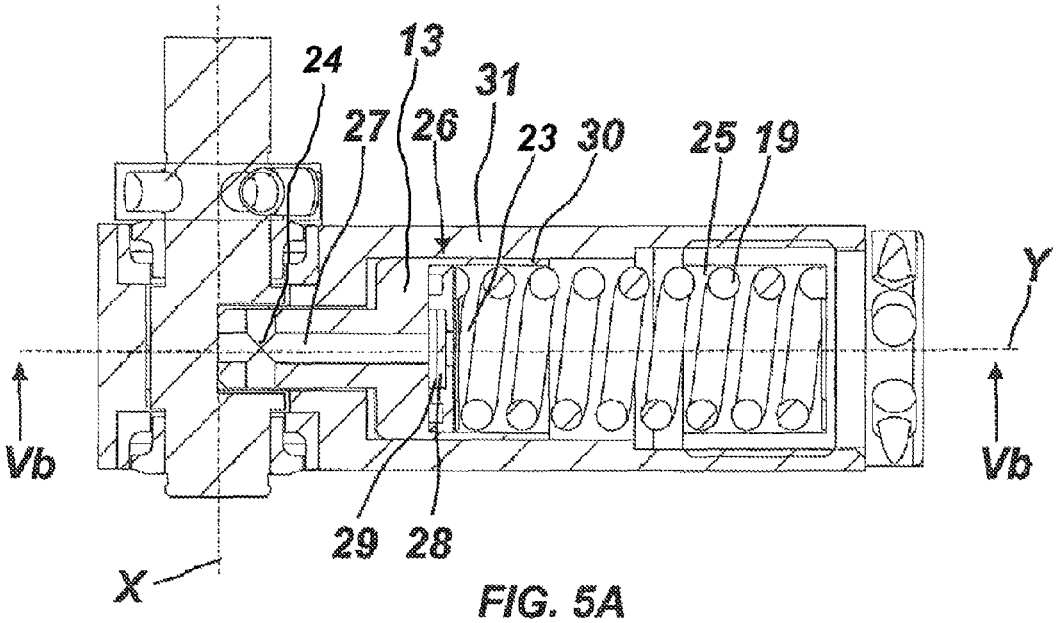
FIG. 5A is a sectional view of the hinge of FIG. 2 in the closed door position.
Figure 5B:
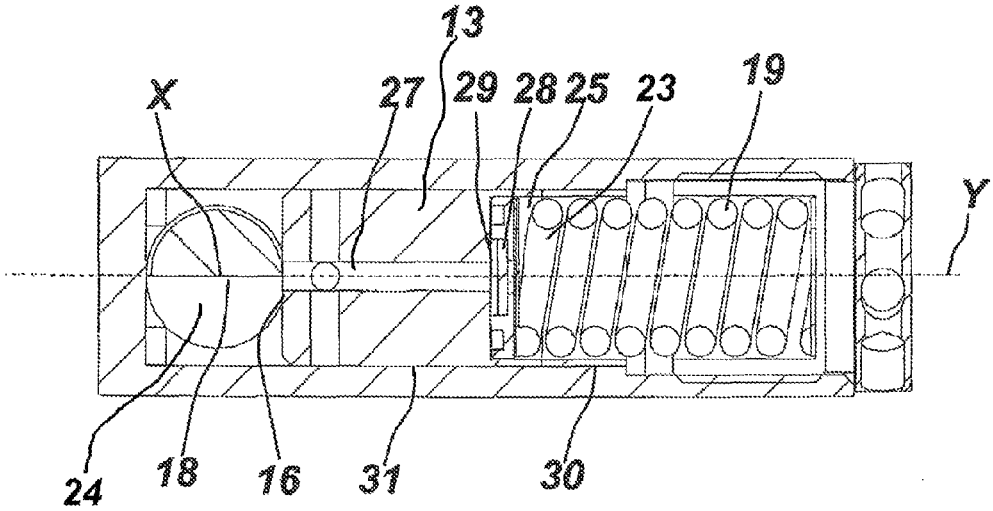
FIG. 5B is a sectional view of the hinge of FIG. 2 in the open door position, taken along a plane VB-VB in FIG. 5A.
Figure 12A:
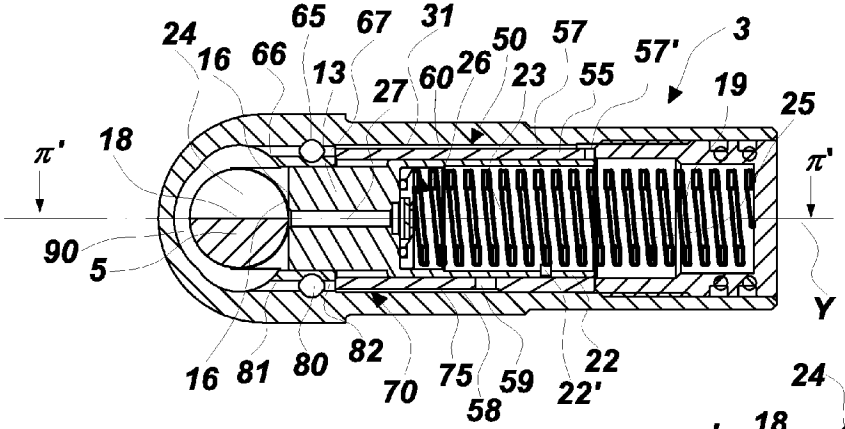
FIG. 12A is a sectional view of the embodiment of the hinge of FIG. 6, in an open door position, wherein the corresponding pass-through holes 59 and 22' of the tubular element 55 and of the plunger element 12 are reciprocally uncoupled.
Figure 12B:
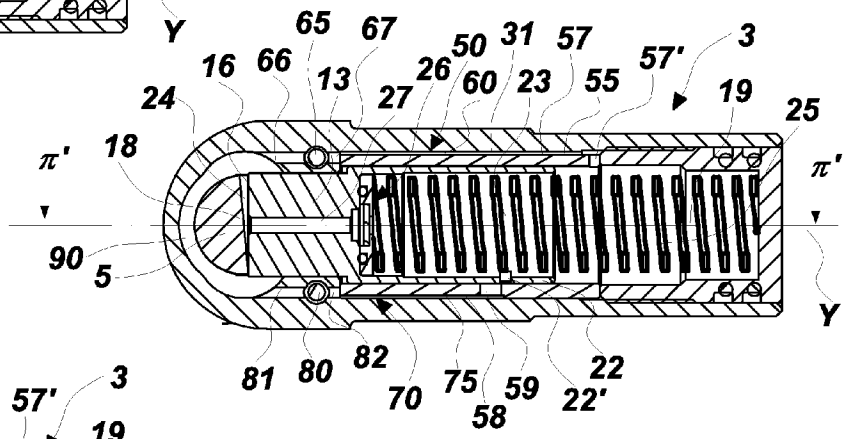
FIG. 12B is a sectional view of the embodiment of the hinge of FIG. 6, in an intermediate position between the open and the closed door position, wherein the corresponding pass-through holes 59 and 22' of the tubular element 55 and of the plunger element 12 are reciprocally coupled, this latter position corresponding to the position wherein the door A latches towards the closed position in proximity of the extended end position.
Figure 12C:
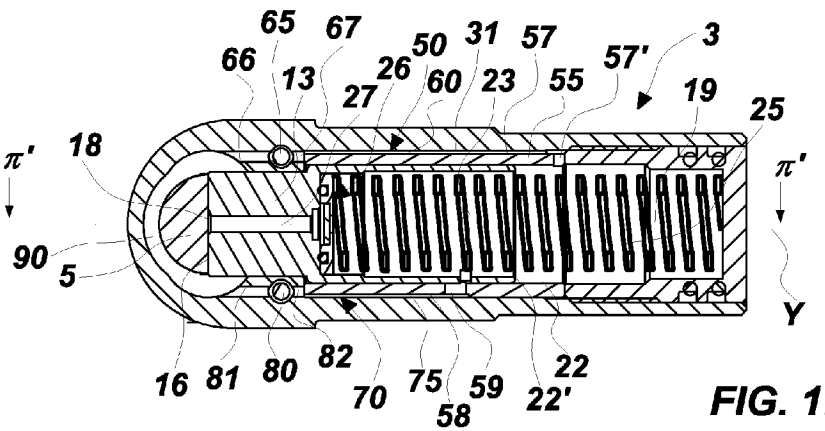
FIG. 12C is a sectional view of the embodiment of the hinge of FIG. 6, in the closed door position.

More precisely, the plunger element 12 may slide along a second axis Y, which may be substantially perpendicular to the first axis X, horizontal in the present example, between a compressed end position, corresponding to the open door position, shown in FIGS. 5B and 12A, and an extended end position, corresponding to the closed door position, shown in FIGS. 5A and 12C.

The plunger element 12 may have a substantially plate-like shaped pushing head 13, interacting with a substantially counter- shaped seat 14 of the cam element 11. Appropriately, the counter- shaped seat 14 may be made in the inner portion 7 of the pin 5.

Advantageously, the pushing head 13 of the plunger element 12 may define a plane $\pi$, substantially perpendicular to the first axis X.

Thanks to such configuration, the bulk of the hinge body, in particular the vertical bulk, will be extremely minimized. This will simplify the insertion thereof in the frame T of the door A or of the stationary support structure S to hide it from sight.

In particular, the plate-like shaped pushing head 13 of the plunger element 12 may have a flat upper wall 15, a flat lower wall 15' and, possibly, a substantially flat front face 16.

In particular, the flat upper and lower walls 15, 15' may be substantially parallel to the second axis Y, whereas the front face 16 may be parallel to the first axis, and may have a height h.

The countershaped seat 14 may comprise a flat upper wall 17 facing a flat lower wall 17' and, possibly, a substantially flat front contact surface 18, suitable to interact and contact engage with the front face 16 of the plunger 12.

It is understood that the pushing head 13 may have any shape, as long as substantially plate-like, without departing from the scope of protection of the invention defined by the terms of the appended claims. For instance, the pushing head 13 may be substantially wedge- shaped, with converging upper and lower walls 15, 15'.

As visible in FIGS. 5A and 12C, in the closed door position, i.e. when the plunger 12 is in the extended end position, the front contact surface 18 of the countershaped seat 14 of the cam 11 may be in contact and parallel with the front face 16 of the pushing head 13 of the plunger 12.

Vice versa, as visible in FIGS. 5B and 12A, in the open door position, i.e. when the plunger 12 is in the compressed end position, the front contact surface 18 of the countershaped seat 14 of the cam 11 may be perpendicular to the front face 16 of the pushing head 13 of the plunger 12.

The front contact face 18 may be parallel to the first axis X, whereas the flat upper and lower walls 17, 17' may be substantially parallel to the second axis Y, and may have a distance h'.

Advantageously, the height h of the front face 16 of the pushing head 13 of the plunger element 12 may be substantially coincident with the distance h' between the upper and lower flat walls 17, 17' of the countershaped seat of the cam 11 , except for the clearance.

Appropriately, the upper and lower flat walls 15, 15' of the pushing head 13 of the plunger 12 may face the upper and lower flat walls 17, 17' of the countershaped seat 14 of the cam 11.

The cam element 11 as well as the plunger element 12 may be housed in a single cylindrical operating chamber 25, made within the box-like hinge body 3 and defined thereby.

Further, the box-like hinge body 3 may have an elongated shape along the axis Y to allow the insertion thereof in the tubular frame T of the door A or of the support structure S to make it not visible from the outside, as shown, respectively, in FIGS. 1 and 2.

In other words, the box-like hinge body 3 may develop mainly in length along the axis Y, with the length dimension larger than the other two dimensions.

To promote the pushing of the head 13 of the plunger 12 against the countershaped seat 14 of the pin 5, that is to promote the interaction between the front face 16 and the contact surface 18, counteracting elastic means may be provided, which may comprise, respectively consist of, a spring 19, acting on the plunger element 12.

Appropriately, the operating chamber 25 may comprise a first generally cylindrical portion 32 having an axis coincident with the second axis Y, a second generally cylindrical portion 33 having an axis coincident with the firs axis X and a third generally parallelepiped-like portion 34, interposed between the first two portions.

The first cylindrical portion 32, having an inner diameter D, may house the spring 19. The second cylindrical portion 33 may house the countershaped seat 14 of the cam element 11. The third parallelepiped-like 34 may have a height h", substantially coincident with the height h of the pushing head 13 of the plunger element 12, to house the pushing head.

The height h" may be remarkably lower, for example about half, than the inner diameter D of the first cylindrical portion 32, so as to allow minimizing the bulk of the box-like hinge body 3. This will cause the hiding by insertion thereof in the frame T of the door A or of the stationary support structure S.

Advantageously, the contact surface 18 of the cam element 11 may be offset with respect to the axis X of a predetermined distance d, such that the front face 16 of the plunger element 12 in its extended end position, illustrated in FIGS. 5A and 12A, is positioned beyond said axis X.

Suitably, the surface 16 may have a distance d from the axis X which may be comprised between 1 mm and 6 mm, preferably comprised between 1 and 3 mm and even more preferably close to 2 mm. Thanks to such feature, the closing movement of the hinge will be completely automatic. In other words, the plunger element 12 will start working after few rotation degrees, starting from the open position.

Advantageously, the first embodiment of the hinge 1 , illustrated in the FIGS, from 3 to 5B1 may comprise mechanical blocking means acting on the closing means 10 to counteract the action thereof, so as to stop the door A in the closed door position.

In such preferred but non-exclusive embodiment, such mechanical blocking means may consist of a blocking element 20, unitary with the pin 5, interacting with a beating member 21, vertically housed in the box-like hinge body 3.

The relative position of the blocking element 20 and of the beating member 21 may be such as the closed door A position corresponds to the extended end position of the plunger 12. Furthermore, by appropriately adjusting the respective position of the blocking element 20 and of the beating member 21 it will be possible to provide a right as well as a left hinge.

Advantageously, in both embodiments illustrated in the annexed figures, the closing means 10 and the hydraulic damping fluid, generally oil, may be both entirely housed in the operating chamber 25. The plunger element 12 may comprise a substantially cylindrical back portion 22, and a front portion defining the pushing head 13.

As particularly visible in FIGS. 5A, 12A, 12B and 12C1 the cylindrical back portion 22 is susceptible to separate the operating chamber 25 into a first and a second adjacent variable volume compartment 23, 24 fluidically connected. The contrasting spring 19 may be housed in the first compartment 23.

As particularly visible in the figures, the first compartment 23 may have its maximum volume in correspondence with the closed door position and its minimum volume in correspondence with the open door position, and the opposite for the second compartment 24.

Advantageously, the operating chamber 25 may comprise control means to control the flow of the working fluid to allow the flow thereof from the first compartment 23 to the second one 24 upon the opening of the door A and to allow the flow thereof from the second compartment 24 to the first one 23 upon the closing of the door.

In both embodiments illustrated in the annexed figures, such control means may comprise a check valve 26, designed so as to allow the flow of the working fluid from the first compartment 23 to the second compartment 24 through the hole 27 passing through the pushing head 13 upon the opening of the door A, and to prevent the backflow of the working fluid upon the closing of the door A.

With this purpose the check valve 26, interacting with the pass-through hole 27, may be of the butterfly type, with the butterfly 28 housed in the compartment 29 in correspondence with the inlet of the passing through hole 27.

This way, when the door is opened, that is when it passes from the closed door position illustrated in FIGS. 5A and 12C to the open door position illustrated in FIGS. 5B and 12A, the working fluid flows from the first compartment 23 to the second compartment 24, by causing the butterfly element 28 to axially slide in the compartment 29 and later flows through the hole 27 into the second compartment 24.

Vice versa, when the door is closed, that is when it passes from the open position illustrated in FIGS. 5B and 12A to the closed position illustrated in FIGS. 5A and 12C, the butterfly element 28 will axially slide in the direction opposite to the opening one and will prevent the backflow of the working fluid through the hole 27.

In order to allow the controlled backflow of the working fluid from the second compartment 24 to the first compartment 23 upon the closing of the door A, the means for controlling the flow of the working fluid may comprise at least one first hydraulic circuit 50 interposed between the outer surface 30 of the upper cylindrical portion 22 of the plunger element 12 and the inner surface 31 of the operating chamber 25.

Thanks to such features, the hinge will be extremely safe, because the reciprocal rotating movement of the stationary and of the movable element is free upon its closing. In fact, upon the closing phase, the oil will flow from the second compartment 24 to the first one 23 independently from the reciprocal rotation speed of the stationary and movable elements.

In this manner, a user will be free to close the door A with any speed without any danger to break the hinge or the door. On the other hand, the speed with which the oil flows back into the compartment 23 will be adjusted by adjusting the passing sections of the first hydraulic circuit 50.

In the first embodiment illustrated in the FIGS, from 3 to 5B, the first hydraulic circuit 50 may be defined by the tubular interspace between the outer surface 30 of the cylindrical back portion 22 of the cam element 12 and the inner surface 31 of the operating chamber 25.

To this end, the plunger element 12 may be housed with a predetermined clearance in the operating chamber 25. The size of the respective clearance between these two elements will substantially adjust the return speed of the door A to its closed position. In such embodiment, at least one hole 35 may be provided for the filling of the working fluid.

In the second embodiment illustrated in the FIGS, from 6 to 12C1 the return of the door A to its closed position may take place in a substantially different way from the first embodiment.

Figure 6:
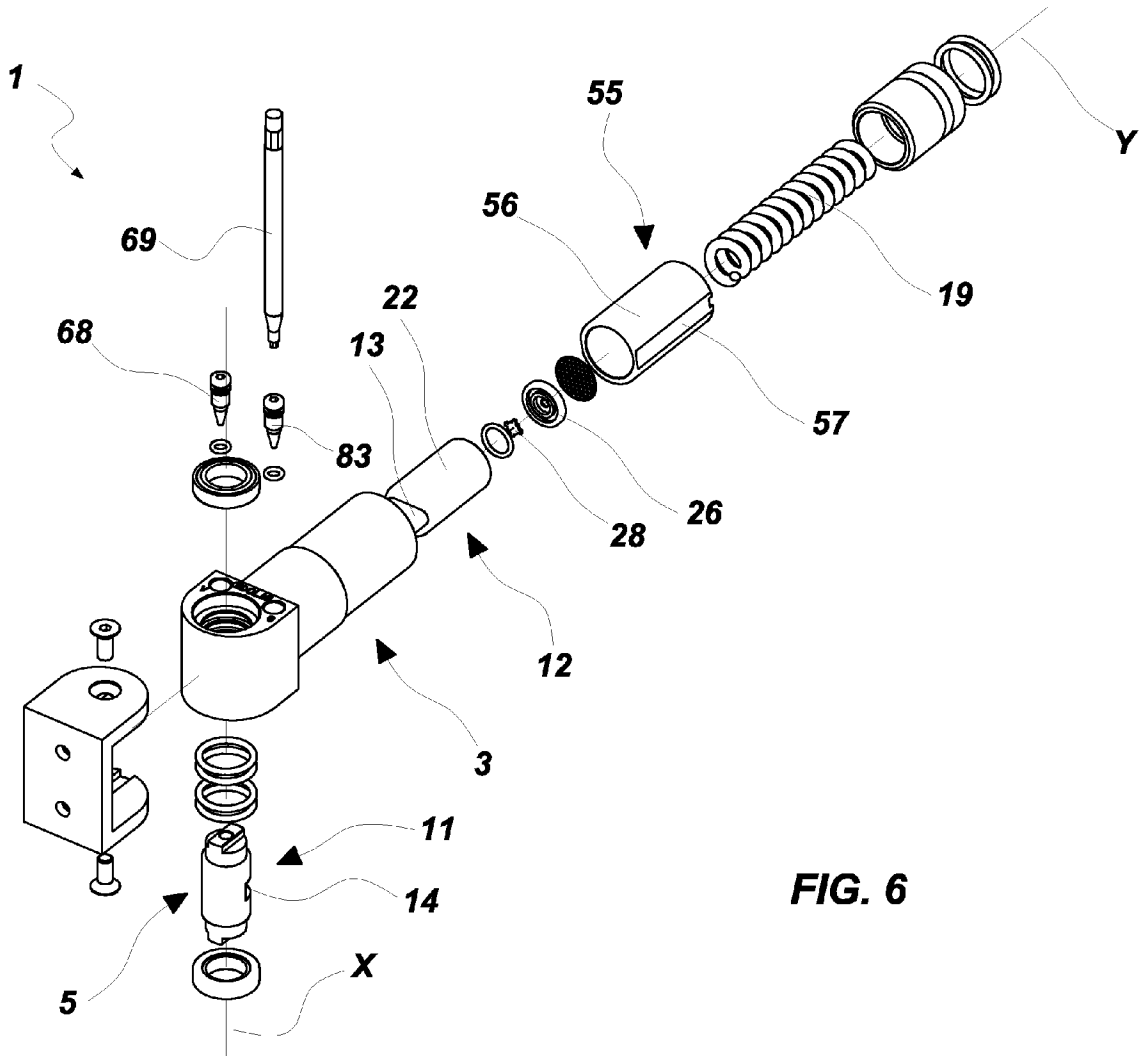
FIG. 6 is an exploded view of a second embodiment of the hinge 1.
Figure 7:
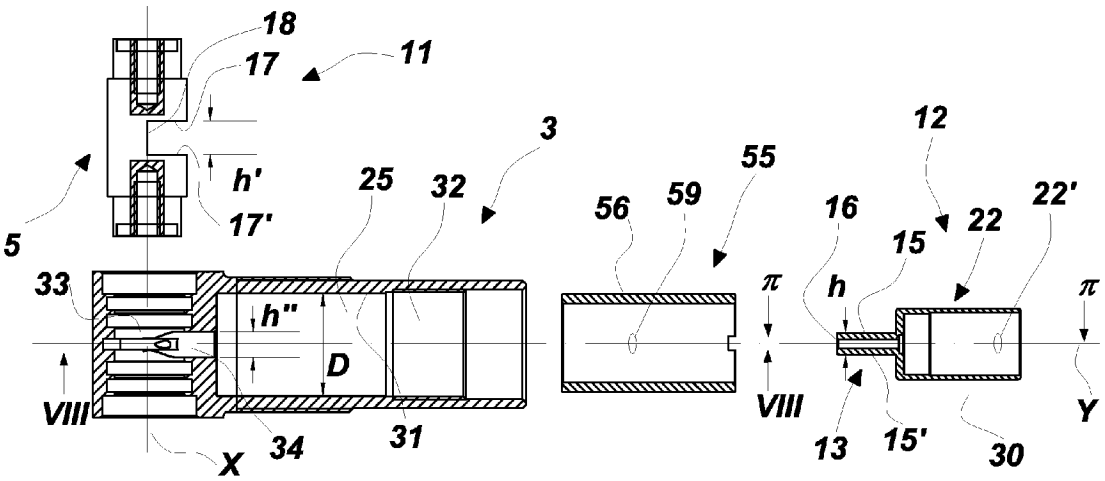
FIG. 7 is a sectional, partially exploded view of a few details of the hinge of FIG. 6.
Figure 9:
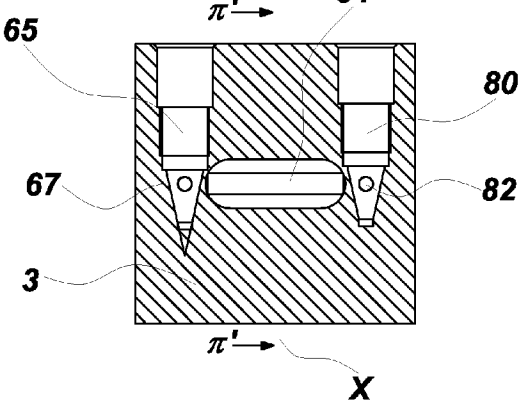
FIG. 9 is a sectional view of the hinge body 3 of the second embodiment of the hinge of FIG. 6, taken along a plane IX-IX in FIG. 8.

As particularly visible in FIG. 6, in fact, in such second embodiment the means for controlling the flow of the working fluid may comprise a tubular element 55, interposed between the inner surface 31 of the operating chamber 25 and the cylindrical back portion 22 of the plunger element 12.

The tubular element 55 may have an external lateral surface 56 which includes a first substantially flat portion 57, made for example by milling.

Appropriately, therefore, the first hydraulic circuit 50 may comprise a first channel 60 which may be defined by the interspace between the inner surface 31 of the operating chamber 25 and the first flat portion 57 of the tubular element 55.

Advantageously, the flat portion 57 may extend for the whole length of the external lateral surface 56 of the tubular element 55, so that the first channel 60 has an end in fluidic communication with the first variable volume compartment 23. In order to facilitate the backflow of the working fluid in this latter compartment the flat portion 57 may comprise a cutting 57'.

In order to have the oil flow through the channel 60 and not elsewhere upon the closing of the door A, the plunger element 12 may be tightly housed within the tubular element 55, whereas this latter may be tightly housed within the operating chamber 25. With this purpose, the respective tolerances between such elements will have to be very slight.

Appropriately, the control means to control the flow of the working fluid within the operating chamber 25 may comprise first adjusting means to adjust the flow of the working fluid in the first hydraulic circuit 50, so as to adjust the rotation speed of the door A from the open to the closed position.

Advantageously, such first adjusting means in the first hydraulic circuit 50 may comprise at least one second inner operating chamber 65 within the box-like hinge body 3, which may have an inlet 66 fluidically connected to the second variable volume 24 and an outlet 67 fluidically connected with the first channel 60, which is in turn fluidically connected with the first variable volume 23.

The first hydraulic circuit 50 for the backflow of the working fluid from the second variable volume compartment 24 to the first variable volume compartment 23 may therefore consist of both of such compartments, as well as of the first channel 60 and of the second operating chamber 65.

Appropriately, this latter may comprise a first adjusting screw 68, that can be operated by a suitable wrench 69, housed in the second chamber 65 to obstruct the passing section of the inlet 66 and/or of the outlet 67, this way adjusting the rotation speed of the door A.

In the preferred but non-exclusive embodiment illustrated in FIGS, from 6 to 12C, the control means to control the flow of the working fluid may comprise a second hydraulic circuit 70, interposed between the outer surface 30 of the cylindrical back portion 22 of the plunger element 12 and the inner surface 31 of the operating chamber 25, such as the first hydraulic circuit 50.

Suitably, such second hydraulic circuit 70 may comprise a second channel 75, which may be defined by the interspace between the inner surface 31 of the operating chamber 25 and a second substantially flat portion 58 of the external lateral surface 56 of the tubular element 55.

The first and the second substantially flat portions 57, 58 of the outer lateral surface 56 of the tubular element 55 may be reciprocally opposite with respect to a plane Tr' passing through the first and second axis X, Y, such as the first and second channel 60, 75.

The means for controlling the flow of the working fluid may further comprise second means for adjusting the flow of the working fluid in the second hydraulic circuit 70, so as to adjust the force by which the door A reaches its closed position.

Preferably, such second adjusting means may be designed to impart a latch action to the door A towards the closed position when the plunger element is in proximity of the extended end position, as illustrated in FIG. 12B.

With this aim, the second substantially flat portion 58 may extend for a part of the length of the outer lateral surface 56 of the tubular element 55.

Advantageously the second substantially flat 58 may furthermore comprise, in proximity of one of its ends, a single pass-through hole or port 59 facing the outer surface 30 of the cylindrical back portion 22 of the plunger element 12.

On the other hand, the cylindrical back portion 22 of the plunger element 12 may have a second pass-through hole or port 22', movable between a first position, illustrated in FIG. 12A and corresponding to the open door position (wherein the plunger element 12 is in proximity of its extended end position), wherein the hole 22' is uncoupled from the first pass-through hole 59 of the tubular element 55, and a second position, illustrated in FIG. 12B and in proximity of the closed door position (wherein the plunger element 12 is in proximity of its compressed end position), wherein the hole 22' is coupled with the first pass-through hole 59 to selectively put into fluidic communication the second channel 75 with the first variable volume compartment 23, this way imparting the latch action to the door A towards the closed position.

In other words, the reciprocal positions of the pass-through holes 59 and 22', respectively made in the tubular element 55 and in the cylindrical portion 22 of the plunger element 12, have to be such that the passing through holes are coupled when the plunger element 12, during its alternative movement along the axis Y1 is in the proximity of the extended end position, as visible in FIG. 12B.

In fact, when the plunger element 12 is in its compressed end position, corresponding to the open door position, the two holes 59 and 22' are reciprocally far and uncoupled so that the working fluid flowing in the second channel 75 in its backflow cycle towards the first compartment 23 is hindered by the outer surface 30 of the cylindrical back portion 22 of the plunger element 12.

As soon as the two holes 59 and 22' are reciprocally coupled, as visible in FIG. 12B, such obstacle is removed, so that the fluid can suddenly fill the compartment 23 causing the impulsive push of the pushing head 13 towards the counter-shaped seat 14, which imparts the latch action to the door towards the closed position.

In order to adjust the impulsive force which causes the latch action, the second hydraulic circuit 70 may comprise a third operating chamber 80 within the box-like hinge body 3.

Such third chamber 80 may have an inlet 81 fluidically connected with the second variable volume compartment 24 and an outlet 82 fluidically connected with the second channel 75, which is in turn selectively put in fluidic communication by the coupling of the holes 59 and 22' of the tubular element 55 and of the cylindrical portion of the plunger element 12.

The second hydraulic circuit 70 for the return of the working fluid from the second variable volume compartment to the first compartment 23 may therefore consist of both of these compartments, as well as of the second channel 75 and of the third operating chamber.

Appropriately, this latter chamber may comprise a second adjusting screw 83, which may be operated by the same wrench 69 which operates the first adjusting screw 68.

The second adjusting screw 83 may be housed in the third operating chamber 80 to obstruct the passing section of the inlet 81 and/or of the outlet 82, so as to adjust the force by which the door A latches to its closed position.

Figure 8:
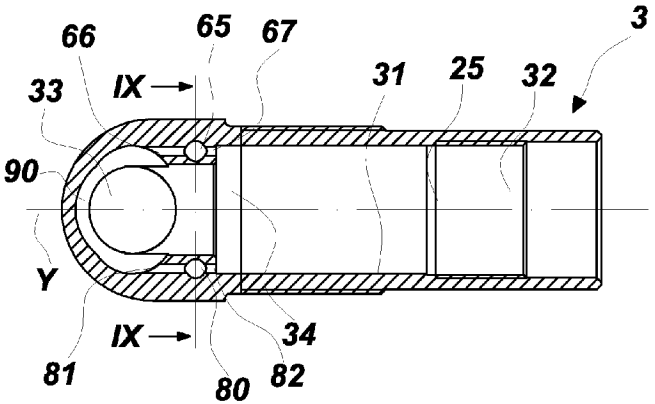
FIG. 8 is a sectional view of the hinge body 3 of the second embodiment of the hinge of FIG. 6, taken along a plane VIII-VIII in FIG. 7.
Figure 10A:
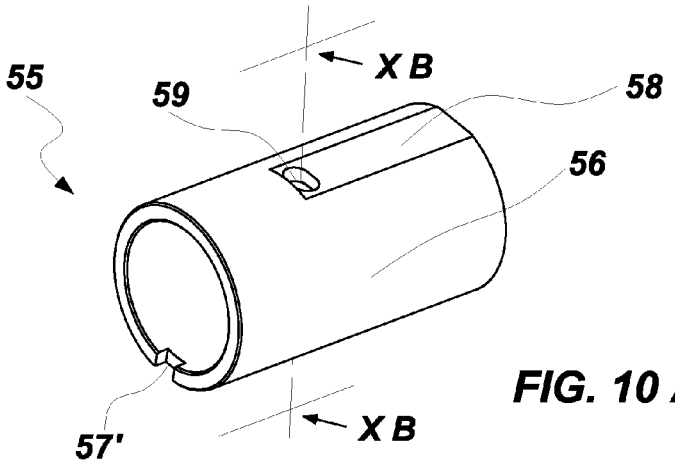
FIGS. 10A, 10B and 10C are views of the tubular element 55 belonging to the second embodiment of the hinge shown in FIG. 6, respectively in axonometric projection, in section along a plane XB-XB and in section along a plane XC-XC.
Figure 10B:
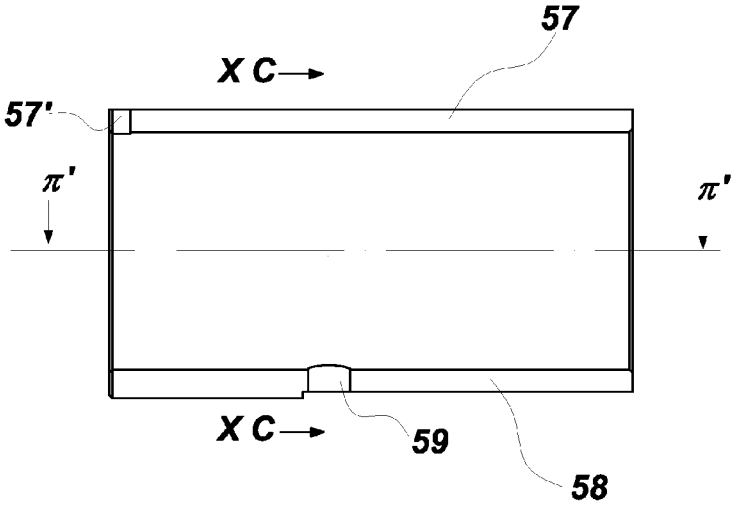
Figure 10C:
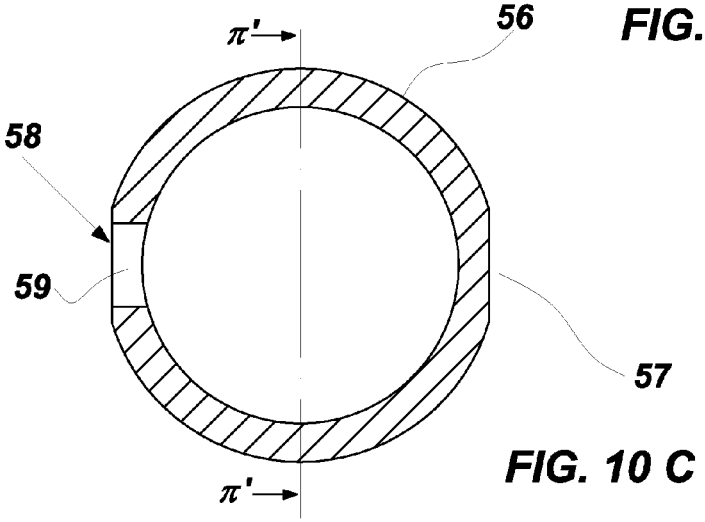
Figure 11A:
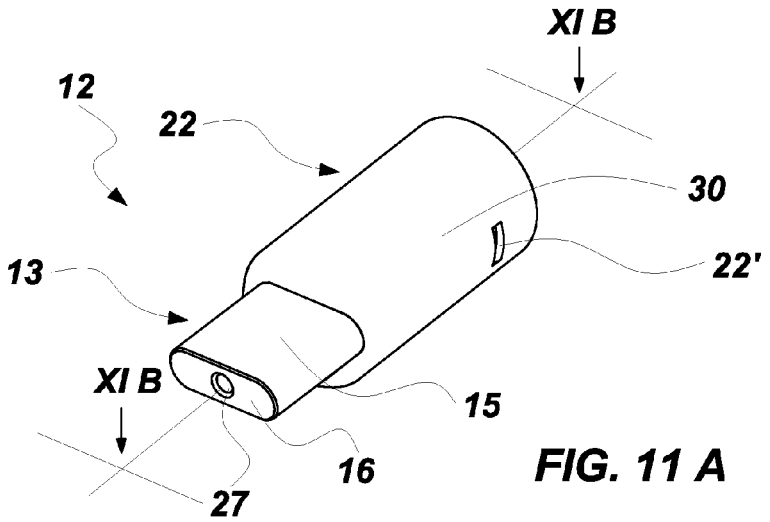
FIGS. 11A, 11 B and 11 C are views of the plunger element 12 belonging to the second embodiment of the hinge shown in FIG. 6, respectively in axonometric projection, in section along a plane XI B-XI B and in section along a plane XI C-XI C.
Figure 11B:
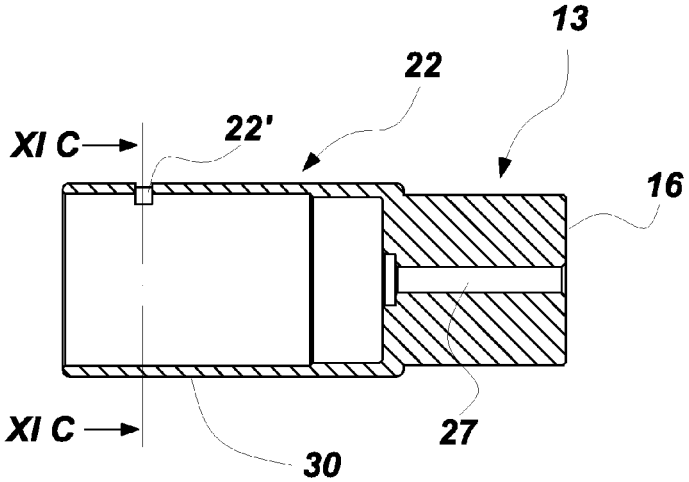
Figure 11C:
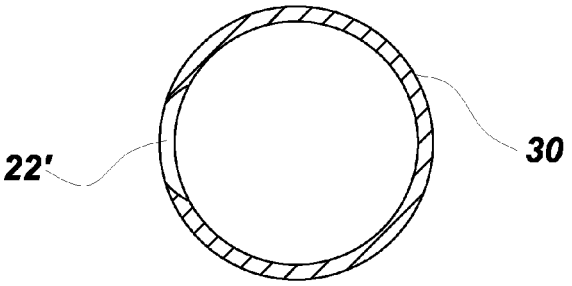

Appropriately, as visible in FIG. 8, the box-like hinge body 3 may comprise a third channel 90 for the fluidic connection of the second operating chamber 65 and of the third operating chamber 80. In particular, the third channel 90 may put into fluidic communication the inlet 66 of the second chamber 65 with the inlet 81 of the third chamber 80.

Thanks to such feature, the hinge 1 will compensate possible deficiencies in the balance of oil circulation, so that the hinge 1 works in the same way in both opening directions of the door A.

From the above description, it is apparent that the hinge according to the invention fulfils the intended objects.

The hinge according to the invention is susceptible to many changes and variants, all falling within the inventive concept expressed in the annexed claims. All particulars may be replaced by other technically equivalent elements, and the materials may be different according to the needs, without departing from the scope of the invention.

Although the hinge has been particularly described referring to the annexed figures, the reference numbers used in the description and claims are used to improve the intelligibility of the invention and do not constitute any limits to the claimed scope.

The invention claimed is:

1. A hinge comprising:

a box-shaped hinge body anchorable to one of a stationary support structure and a door;

a pin disposed along a first longitudinal axis and anchorable to the other one of the stationary support structure and the door, the pin and the box-shaped hinge body being rotatably coupled such to rotate around the first axis between an open door position and a closed door position, the pin having a cam element defined therein;

a closing member configured to automatically return the door from the open position to the closed position; and a working fluid acting on the closing member to hydraulically counteract an action thereof, thus controlling door rotation from the open position to the closed position, wherein the closing member comprises a plunger element slidably movable in an operating chamber within the box-shaped hinge body along a second axis substantially perpendicular to the first axis between a compressed end position, corresponding to the open door position and an extended end position, corresponding to the closed door position, the plunger element being coupled to a pushing head interacting with a substantially countershaped seat of the cam element, wherein the closing member and the working fluid are both entirely housed in the operating chamber, and wherein the box-shaped hinge body has an elongated shape extending along the second axis, the pushing head being substantially plate-shaped to define a plane substantially perpendicular to the first axis.

2. The hinge of claim 1, wherein the pushing head has a first couple of substantially flat upper and lower walls, the substantially countershaped seat of the cam element comprising a second couple of substantially flat upper and lower walls shaped to correspond to upper and lower walls of the first couple.

3. The hinge of claim 2, wherein the upper and lower flat walls of the first couple and of the second couple are all substantially parallel to the second axis.

4. The hinge of claim 2, wherein the pushing head has a front face having a predetermined height which is substantially equal to a distance between the upper and lower walls of the substantially countershaped seat, the front face being susceptible to contact engage with a contact surface of the substantially countershaped seat.

5. The hinge of claim 4, wherein both the front face and the contact surface are substantially flat and parallel to the first longitudinal axis, the front face and the contact surface being substantially parallel to each other in the closed door position and being substantially perpendicular to each other in the open door position.

6. The hinge of claim 1, wherein the closing member comprises a counteracting elastic element acting on the plunger element to promote a reciprocal interaction of the pushing head and the substantially countershaped seat, the operating chamber comprising a first generally cylindrical portion having an axis coinciding with the second axis and housing the counteracting elastic element, a second generally cylindrical portion having axis coinciding with the first axis and housing the substantially countershaped seat, and a third generally parallelepiped-shaped portion interposed between the first and the second portions and housing the pushing head.

7. The hinge of claim 6, wherein the third parallelepiped-shaped portion has a height lower than an inner diameter of the first cylindrical portion.

8. The hinge of claim 1, wherein the pin is partially inserted in the box-shaped hinge body and has a first portion extending from the box-shaped hinge body and configured to anchor to the stationary support structure or to the door, and a second portion disposed within the box-shaped hinge body which comprises the cam element.

9. The hinge of claim 1, wherein a contact surface of the cam element is offset with respect to the first longitudinal axis by a predetermined distance such that a front face of the pushing head in the extended end position is located beyond the first longitudinal axis.

10. The hinge of claim 9, wherein the contact surface has a distance from the first longitudinal axis comprised between 1 mm and 6 mm.

11. The hinge of claim 1, wherein the plunger element comprises a substantially cylindrical back portion and a front portion defining the pushing head, the back portion being designed to separate the operating chamber into a first and a second variable volume compartments in reciprocal fluidic communication.

12. The hinge of claim 11, wherein the first and the second variable volume compartments are adjacent.

13. The hinge of claim 11, wherein the first and the second variable volume compartments are designed to have, in correspondence with the closed door position, respectively a maximum and a minimum volume, a counteracting elastic element being located into the first variable volume compartment.

14. The hinge of claim 11, wherein the pushing head comprises a pass-through hole putting the first variable volume compartment and the second variable volume compartment into fluidic communication and a check valve interacting with the pass-through hole to allow a flow of the working fluid from the first variable volume compartment to the second variable volume compartment upon opening the door and to prevent a backflow thereof upon closing the door, the hinge further comprising at least one first hydraulic circuit interposed between an outer surface of the substantially cylindrical back portion of the plunger element and an inner surface of the operating chamber that controls the backflow of the working fluid from the second variable volume compartment to the first variable volume compartment upon closing the door.

15. The hinge of claim 14, further comprising a tubular element interposed between the inner surface of the operating chamber and the cylindrical back portion of the plunger element, the plunger element being tightly housed in the tubular element, the tubular element being tightly housed in the operating chamber.

16. The hinge of claim 15, wherein the tubular element has an outer lateral surface which includes a first substantially flat portion, the at least one first hydraulic circuit including a first channel defined by an interspace between the inner surface of the operating chamber and the first substantially flat portion, the first substantially flat portion extending for an entire length of an outer lateral surface of the tubular element to provide fluidic communication between the at least one first channel and the first variable volume compartment.

17. The hinge of claim 16, further comprising a second operating chamber internal to the box-shaped hinge body which has an inlet fluidically connected with the second variable volume compartment and an outlet fluidically connected with the at least one first channel, the second operating chamber comprising a first adjusting screw inserted into the second operating chamber to obstruct a passing section of the inlet or the outlet, thus adjusting rotation speed of the door from the open position to the closed position.

18. The hinge of claims 17, further comprising a second hydraulic circuit interposed between the outer surface of the substantially cylindrical back portion of the plunger element and the inner surface of the operating chamber to control the backflow of the working fluid from the second variable volume compartment to the first variable volume compartment upon closing the door, the outer lateral surface of the tubular element including a second substantially flat portion, the second hydraulic circuit comprising a second channel interposed between the inner surface of the operating chamber and the second substantially flat portion, the second substantially flat portion extending only for a part of the length of the outer lateral surface of the tubular element, the tubular element including a first pass-through hole in proximity of an end of the second substantially flat portion facing the outer surface of the cylindrical back portion of the plunger element, the cylindrical back portion of the plunger element having a second pass-through hole, the first and the second pass-through holes being reciprocally uncoupled when the plunger element is in proximity of the compressed end position and reciprocally coupled when the plunger element is in proximity of the extended end position to selectively put the second channel and the first variable volume compartment in fluidic communication, such to impart a latch action to the door toward the closed position.

19. The hinge of claim 18, wherein the first substantially flat portion and the second substantially flat portion of the outer lateral surface of the tubular element, and respectively the first channel and second channel, are disposed opposite with respect to a plane passing through the first axis and second axis.

20. The hinge of claim 18, further comprising a third operating chamber provided internally to the box-shaped hinge body and having an inlet fluidically connected with the second variable volume compartment and an outlet fluidically connected with the at least one second channel, a second adjusting screw being housed in the third operating chamber such to obstruct a passing section of the inlet or the outlet of the third operating chamber, thereby adjusting a force by which the latch action is imparted to the door.

21. The hinge of claim 20, wherein the box-shaped hinge body comprises a third channel to fluidically connect the second operating chamber and the third operating chamber.

* * * * *